US007225651B2

(12) United States Patent
Edwards et al.

(10) Patent No.: US 7,225,651 B2
(45) Date of Patent: Jun. 5, 2007

(54) PICK-RESISTANT WAFER TUMBLER LOCK WITH SIDEBARS

(75) Inventors: Billy B. Edwards, Brookfield, WI (US); James L. Welch, Waukesha, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 10/707,816

(22) Filed: Jan. 14, 2004

(65) Prior Publication Data

US 2004/0159136 A1 Aug. 19, 2004

Related U.S. Application Data

(63) Continuation-in-part of application No. 10/187,727, filed on Jul. 2, 2002.

(60) Provisional application No. 60/439,956, filed on Jan. 14, 2003, provisional application No. 60/302,643, filed on Jul. 2, 2001.

(51) Int. Cl.
*E05B 29/04* (2006.01)

(52) U.S. Cl. ..... 70/369; 70/492; 70/495

(58) Field of Classification Search ..... 70/495, 70/496, 367–369, 371, 491–494
See application file for complete search history.

(56) References Cited

U.S. PATENT DOCUMENTS

| | | | | |
|---|---|---|---|---|
| 1,906,701 | A | 5/1933 | Maxwell et al. | |
| 1,915,897 | A | 6/1933 | Maxwell et al. | |
| 1,965,336 | A | 7/1934 | Fitz Gerald | |
| 2,003,086 | A * | 5/1935 | Liss | 70/495 |
| 2,024,441 | A | 12/1935 | Fitz Gerald | |
| 2,123,940 | A | 7/1938 | Gray | |
| 2,405,911 | A | 8/1946 | Swanson | |
| 2,426,104 | A | 8/1947 | Johnstone | |
| 2,460,551 | A | 2/1949 | Swanson | |
| 2,687,639 | A | 8/1954 | Swanson | |
| 2,949,762 | A | 8/1960 | Johnstone | |
| 3,002,268 | A | 10/1961 | Spain | |
| 3,035,433 | A | 5/1962 | Testa | |
| 3,455,130 | A | 7/1969 | Basseches | |
| 3,479,848 | A | 11/1969 | Golden | |
| 3,854,311 | A | 12/1974 | Mercurio | 70/377 X |

(Continued)

FOREIGN PATENT DOCUMENTS

| | | |
|---|---|---|
| FR | 2279911 | 2/1976 |

(Continued)

*Primary Examiner*—Lloyd A. Gall
(74) *Attorney, Agent, or Firm*—Calfee, Halter & Griswold, LLP

(57) ABSTRACT

The invention provides a pick-resistant locking mechanism with wafer tumblers, sidebars and an interchangeable cylinder that allows re-keying of the lock. The sidebars have projections with beveled sides that engage with cavities in the lock shell when rotational torque is applied to the lock in the absence of the correct key. A sidebar of the lock contacts two, nonadjacent wafer tumblers. The wafer tumblers have indentations that engage cavities in the lock shell when rotational torque is applied during picking of the lock. Tolerance between sidebars and the lock shell is less than the tolerance between tumblers and the lock shell. The tumbler springs are not accessible from the keyway of the lock and are more powerful than the sidebar springs.

22 Claims, 14 Drawing Sheets

U.S. PATENT DOCUMENTS

| | | | | | |
|---|---|---|---|---|---|
| 3,985,010 | A | | 10/1976 | Idoni | 70/378 X |
| 3,999,413 | A | | 12/1976 | Raymond et al. | 70/377 X |
| 4,015,458 | A | | 4/1977 | Mercurio | 70/377 X |
| 4,085,601 | A | | 4/1978 | Sauder | 70/377 X |
| 4,292,823 | A | | 10/1981 | Reinhard et al. | 70/377 X |
| 4,356,713 | A | | 11/1982 | Widen | 70/358 X |
| 4,377,940 | A | * | 3/1983 | Hucknall | 70/495 |
| 4,539,828 | A | * | 9/1985 | Teleky | 70/369 |
| 4,561,270 | A | * | 12/1985 | Spreng | 70/495 |
| 4,635,455 | A | * | 1/1987 | Oliver | 70/494 |
| 4,711,106 | A | | 12/1987 | Johnson | |
| 4,712,399 | A | * | 12/1987 | Mattossovich | 70/495 |
| 4,712,400 | A | * | 12/1987 | Steinbach | 70/369 |
| 4,750,342 | A | | 6/1988 | Nakai | 70/377 X |
| 4,977,767 | A | | 12/1990 | Prunbauer | 70/406 |
| 5,001,914 | A | | 3/1991 | Edwards | 70/495 |
| 5,134,871 | A | | 8/1992 | Makino et al. | 70/492 |
| 5,209,087 | A | | 5/1993 | Cox | 70/369 |
| 5,375,444 | A | | 12/1994 | Smith | 70/495 |
| 5,419,168 | A | * | 5/1995 | Field | 70/494 |
| 5,454,246 | A | | 10/1995 | Mueller | 70/495 |
| 5,475,998 | A | | 12/1995 | Raskevicius et al. | 70/495 |
| 5,611,225 | A | | 3/1997 | Resch et al. | 70/422 |
| 5,709,115 | A | | 1/1998 | Richter | 70/495 |
| 5,826,451 | A | | 10/1998 | Cook | 70/495 |
| 5,839,307 | A | * | 11/1998 | Field et al. | 70/283 |
| 5,956,986 | A | | 9/1999 | Vonlanthen | 70/492 |
| 5,964,107 | A | | 10/1999 | Chang | |
| 6,079,240 | A | * | 6/2000 | Shvarts | 70/367 |
| 6,257,154 | B1 | * | 7/2001 | Kasper | 109/73 |
| 6,427,506 | B1 | | 8/2002 | Prunbauer | 70/495 |
| 6,564,601 | B2 | | 5/2003 | Hyatt Jr. | 70/278.3 |
| 6,634,197 | B2 | * | 10/2003 | Widen et al. | 70/369 |
| 6,968,717 | B2 | * | 11/2005 | Suzuki et al. | 70/492 |
| 6,978,647 | B2 | * | 12/2005 | Edwards et al. | 70/495 |
| 2006/0032280 | A1 | * | 2/2006 | Edwards et al. | 70/495 |

FOREIGN PATENT DOCUMENTS

| | | |
|---|---|---|
| FR | 2410718 | 6/1979 |
| GB | 607199 | 8/1948 |
| GB | 2041061 | 9/1980 |
| JP | 5351100 | 5/1978 |
| JP | 1278668 | 11/1989 |
| JP | 1-299968 | 12/1989 |
| JP | 3-47380 | 2/1991 |
| JP | 4-1985 | 7/1992 |

* cited by examiner

FIG. 9
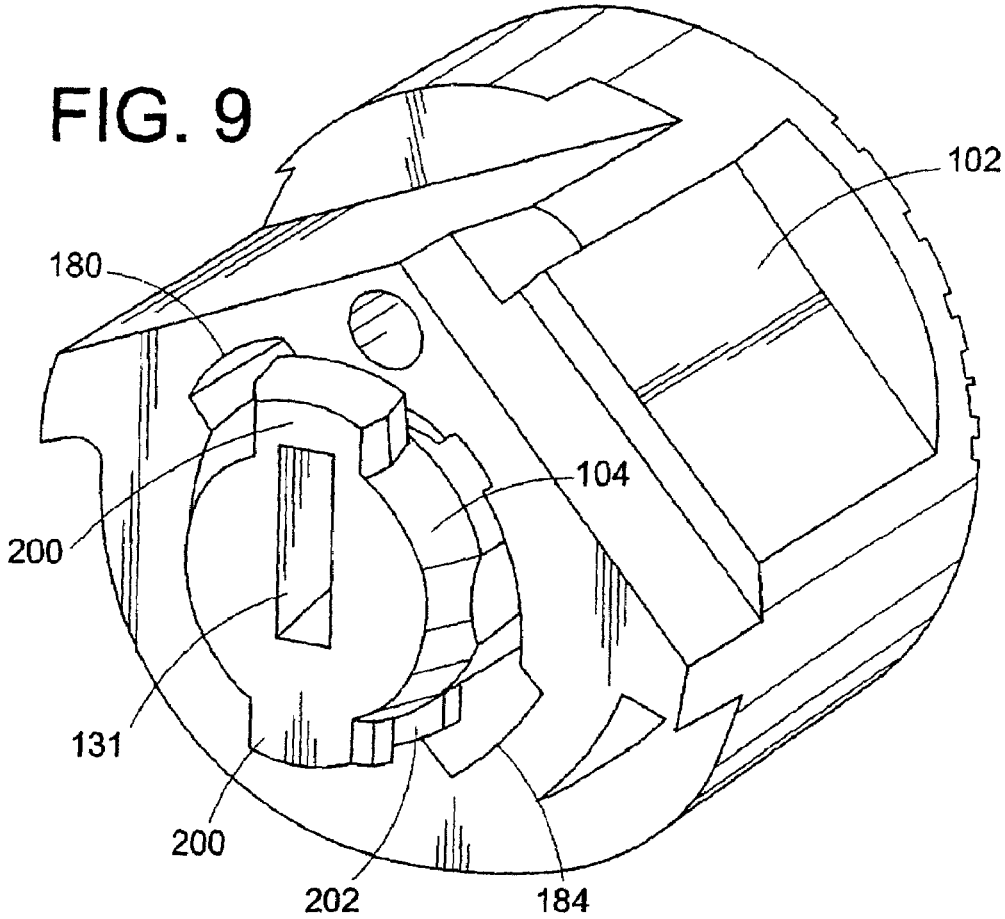
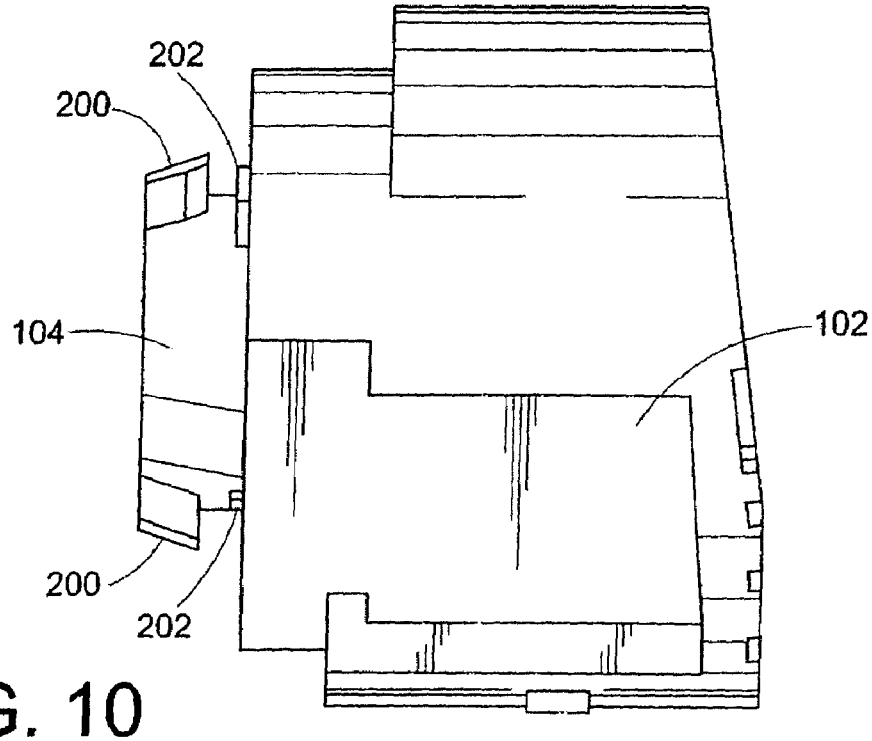
FIG. 10

PICK-RESISTANT WAFER TUMBLER LOCK WITH SIDEBARS

CROSS REFERENCE TO RELATED APPLICATIONS

This application is a continuation-in-part of U.S. patent application Ser. No. 10/187,727, filed on Jul. 2, 2002, which claims priority to U.S. Provisional Patent Application Ser. No. 60/302,643, filed Jul. 2, 2001. This application also claims priority to U.S. Provisional Patent Application Ser. No. 60/439,956 filed Jan. 14, 2003.

BACKGROUND OF INVENTION

The invention relates to a pick-resistant locking mechanism, and more specifically to a locking mechanism with wafer tumblers and sidebars that interact to provide pick-resistant features.

Pin-tumbler locking mechanisms contain a cylinder plug which rotates within a tightly-fitting cylindrical housing or shell. Channels containing elongated top and bottom pin tumblers extend perpendicularly through the cylinder plug and shell. The pin tumblers slide up and down within the channels to provide for a locked and unlocked position. When the top or bottom pin tumbler spans both the cylinder plug and shell, the pin tumbler is in a position of interference and the cylinder plug is locked and therefore unable to rotate within the shell. When the correct key is inserted into the keyway of the lock, the notches on the key contact the bottom pin tumblers and slide the pin tumblers within the channels so that the entire length of the bottom pin tumbler is positioned within the cylinder plug at its outside diameter. As such, the pin tumblers are in a position of non-interference, and the cylinder plug is unlocked thereby allowing the cylinder plug to rotate within the shell when rotational torque is applied by the key.

Locks can be picked, or opened without a key. FIGS. 1A–1G illustrate one conventional lock picking technique. As shown in FIG. 1, a lock housing or shell A is provided with a rotateable cylinder plug B housed therein. A set of channels C extend through the shell A and cylinder plug B and contain spring-loaded pin tumblers D. In the locking mechanism shown in FIG. 1, the pin tumblers D have two parts which can separate when aligned along the shear line E by the correct key (not shown). In order to pick the lock, a tension wrench F is inserted into the keyway G of the lock, as shown in FIG. 1B, and rotational torque is applied to the cylinder plug B. Since the pins D are in a position of interference with the cylinder plug B and shell A, the cylinder plug B is unable to rotate within the shell A. However, due to imperfections and misalignments in the mechanism, the torque applied by the tension wrench F can cause slight rotation of the cylinder plug B which results in small offsets between the channels C in the cylinder plug B and the shell A. This offsetting of the channels C creates a ledge along the surface of the channels C along the shear line E. A pick H is then inserted into the keyway G and used to slide one of the pin tumblers D up its respective channel C so that the end of the pin tumbler D rests on the ledge created along the shear line E, as shown in FIG. 1C. Continued application of the rotational torque causes the pin tumbler D to remain wedged in this position of non-interference. As shown in FIGS. 1D–1F, the pick His then used to position each of the other pin tumblers D on the ledge one at a time. As shown in FIG. 1G, once all of the pin tumblers D are positioned on the ledge, the cylinder plug B can rotate within the shell A, thereby allowing the locking mechanism to be unlocked.

An alternative to the pin-tumbler lock is the wafer-tumbler locking mechanism. Wafer-tumbler locks require less strict tolerances between components and, therefore, are advantageous in that they are more economical to manufacture than pin tumbler locks. Wafer tumbler locks have thin wafer-shaped tumblers which slide up and down within slots that span both the cylinder plug and shell. The wafer tumblers are spring loaded so that they extend out of the cylinder plug and into a cavity within the lock shell. In this position of interference, the extended wafer tumblers prevent rotation of the cylinder plug within the shell. The center of each of the wafer tumblers has an opening so that a key can be inserted into the keyway and through the wafer tumblers. The correct key contacts the wafer tumblers and moves the wafer tumblers within the slots so that they are retracted from the cavity within the lock shell and positioned within the cylinder plug. So positioned, the wafer tumblers are in a position of non-interference and rotational torque applied to the cylinder plug causes its rotation within the shell and unlocking of the mechanism. Insertion of an incorrect key into the lock keyway will not result in placement of the wafer tumblers in a position of non-interference.

Since wafer tumbler locks are easier to pick, its resistance to picking can be increased by placing a second locking feature within the lock. One such locking feature that has been used in the past is a spring-loaded sidebar. A side-bar is positioned within its own slot in the cylinder plug, the slot cut perpendicular to the slot within which the wafer-tumblers slide. Positioned within a sidebar slot, a sidebar can contact a wafer tumbler. Two types of sidebar can be used, those that are sprung away from the tumblers and those that are sprung toward the tumblers. There are distinct advantages to using the type that is sprung toward the tumblers. For example, a sidebar that is sprung away from the tumblers can be forced into the tumblers and into a position of non-interference by the application of rotational torque. On the other hand, a sidebar that is sprung toward the tumblers will not seat properly in the tumbler upon the application of rotational torque. When the wafer tumbler is in a position of interference, the wafer tumblers contact with the sidebar prevents the sidebar from withdrawing from the cavity within the shell. So positioned, the sidebar spans the cylinder plug and shell and keeps the cylinder plug from rotating within the shell. When the wafer tumbler is in a position of non-interference, the wafer tumbler contact with the sidebar is changed such that the sidebar is no longer held within the cavity of the shell and therefore does not span the cylinder plug and shell. When the sidebar is so positioned, rotational torque causes the cylinder plug to rotate within the shell.

Although wafer-tumbler locks are more economical to produce and are of smaller size than some other tumbler locking mechanisms, pin-tumbler locks for example, they are typically less resistant to picking than pin-tumbler locks. There is a need for a wafer-tumbler locking mechanism that is more pick-resistant.

SUMMARY OF INVENTION

A pick-resistant locking mechanism including wafer tumblers and sidebars is provided. In one embodiment, the sidebars have projections with beveled sides that engage with cavities in the lock shell when rotational torque is applied in the absence of the correct key. The tolerance between the sidebar and the lock shell is less than the tolerance between tumblers and the lock shell. When rotational torque is applied in the absence of the correct key, the tolerance difference provides for engagement of the sidebar projections with the cavities of the lock shell before tumblers engage with the lock shell.

In another embodiment, each sidebar contacts two, non-adjacent wafer tumblers. An important aspect of the present invention is that the tumbler springs are not accessible from the keyway of the lock. In such an arrangement, the tumbler springs cannot be displaced, thereby allowing movement of the tumblers, by an attack from the keyway. Furthermore, in one embodiment, the tumbler springs are more powerful than the sidebar springs making it impossible to align the tumbler cutout for the sidebar with the projection on the sidebar without continuous support of the tumbler in the proper position. Additionally, tumbler indentations may be included to engage shell projections when rotational torque is applied to the cylinder in the absence of the correct key.

Another aspect of the present invention is a pick-resistant wafer cylinder lock that includes an interchangeable cylinder that allows rapid re-keying of the lock by swapping of one cylinder for another.

Still, other advantages and benefits of the invention will be apparent to those skilled in the art upon reading and understanding of the following detailed description.

BRIEF DESCRIPTION OF DRAWINGS

The present invention may be more readily understood by reference to the following drawings. While certain embodiments are shown as illustrative examples of the invention, the scope of this application should not be construed as limited to these illustrative examples.

FIG. 9 is a view of the cylinder assembly fully inserted and partially rotated within the shell of the wafer lock.

FIG. 10 is a top view of the cylinder assembly shown in FIG. 9.

DETAILED DESCRIPTION

Figure 1A:
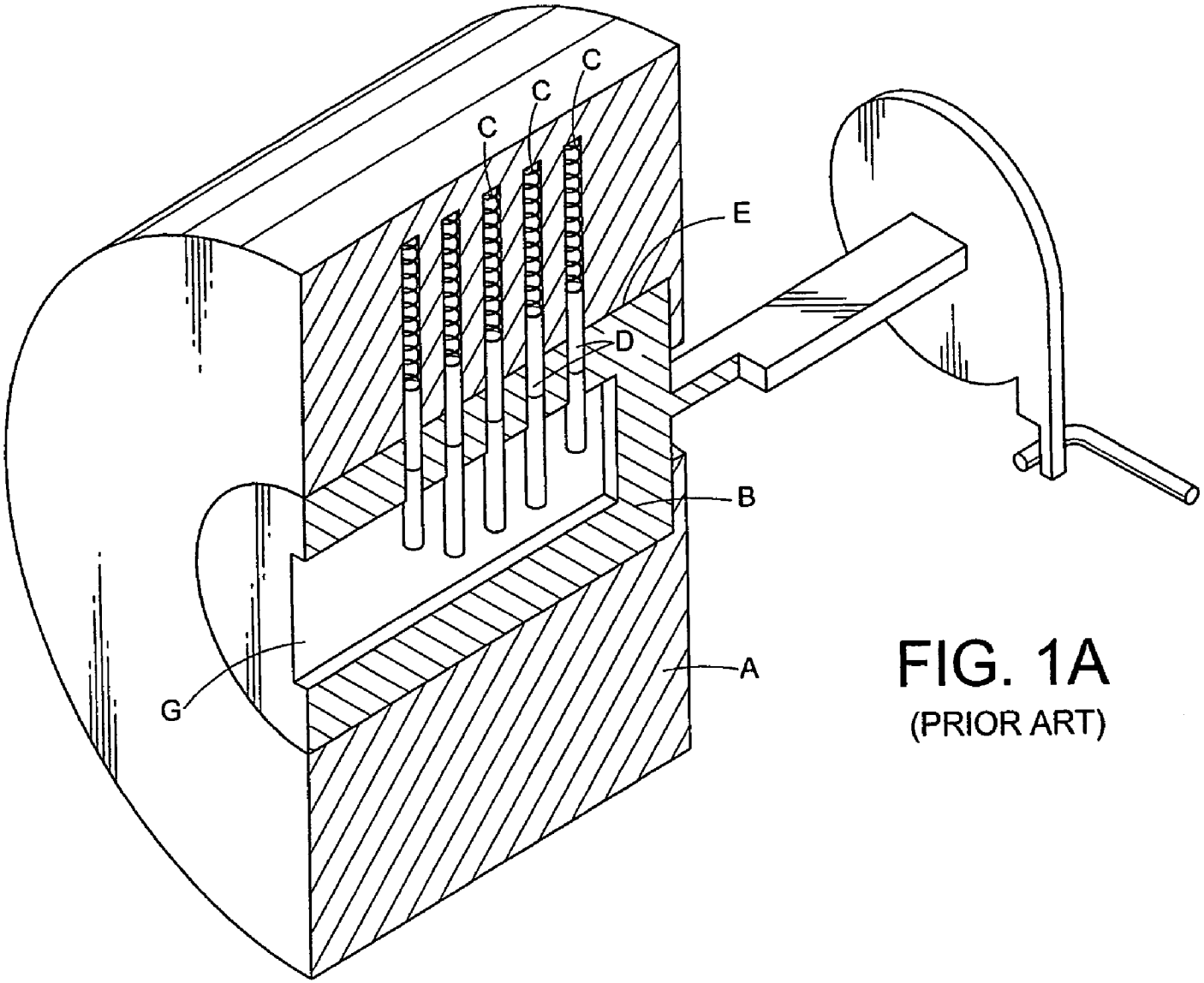
FIG. 1A (PRIOR ART)
FIGS. 1A–1G are cross-sectional views of a conventional locking mechanism illustrating a typical lock picking technique.
Figure 1B:
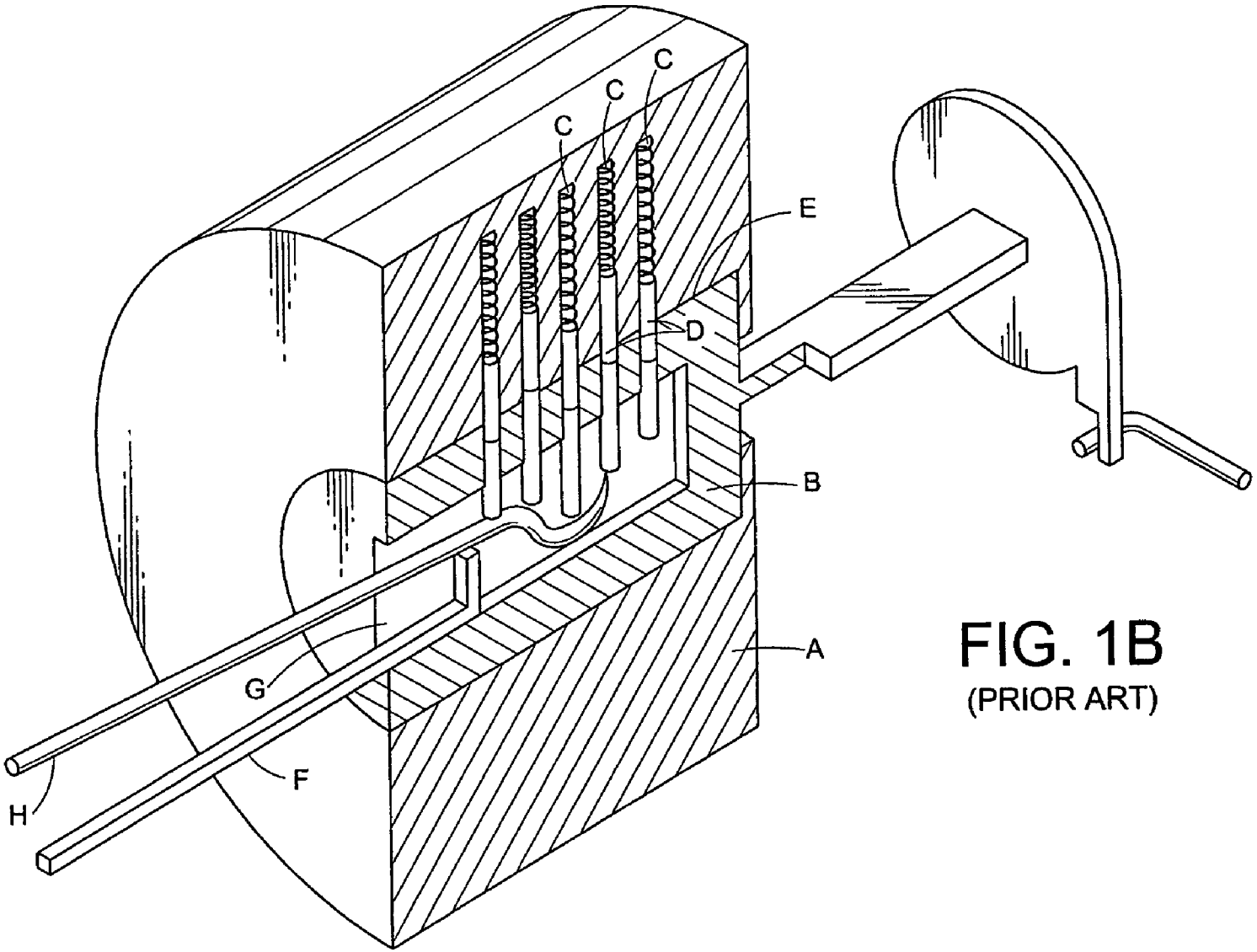
FIG. 1B (PRIOR ART)
Figure 1C:
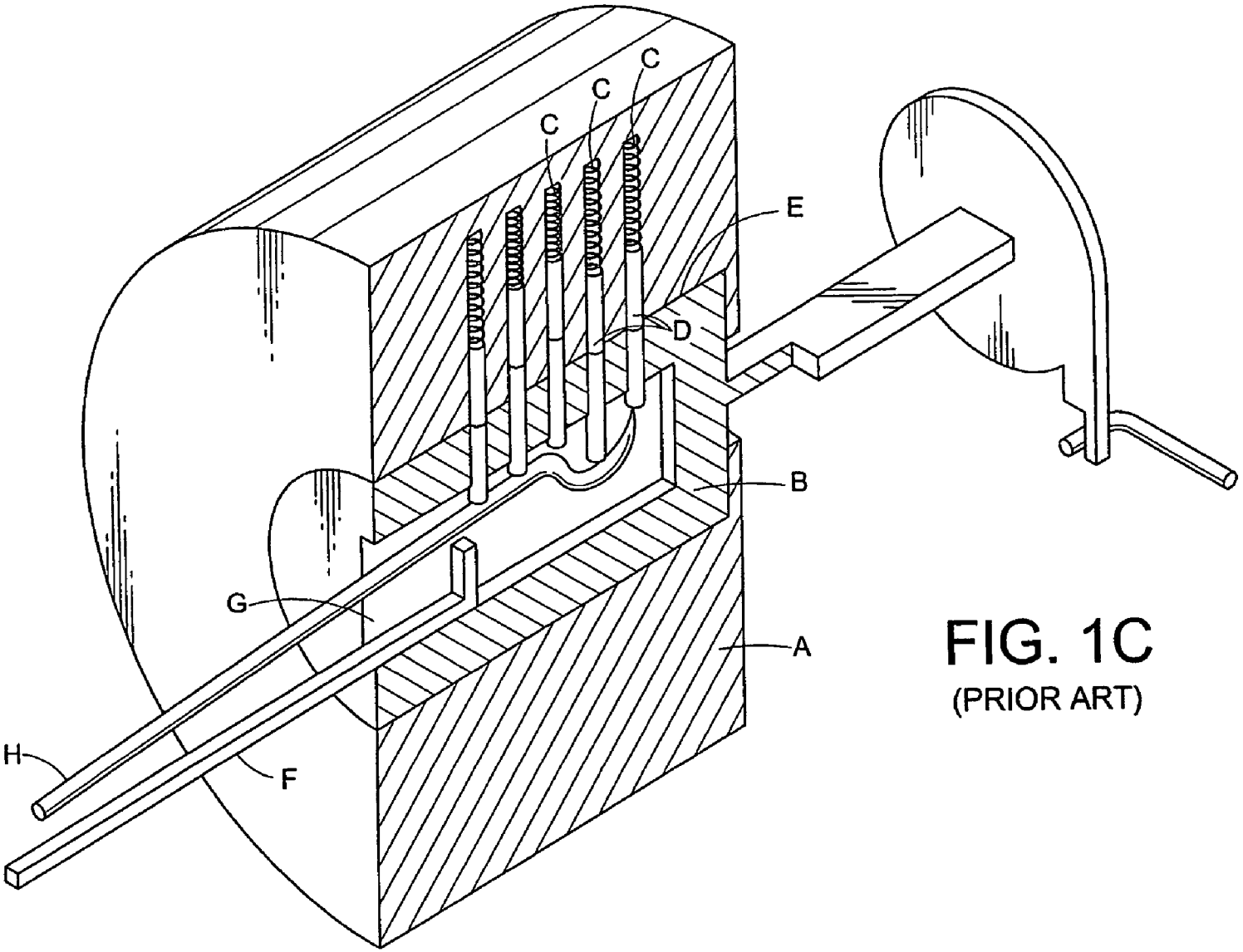
FIG. 1C (PRIOR ART)
Figure 1D:
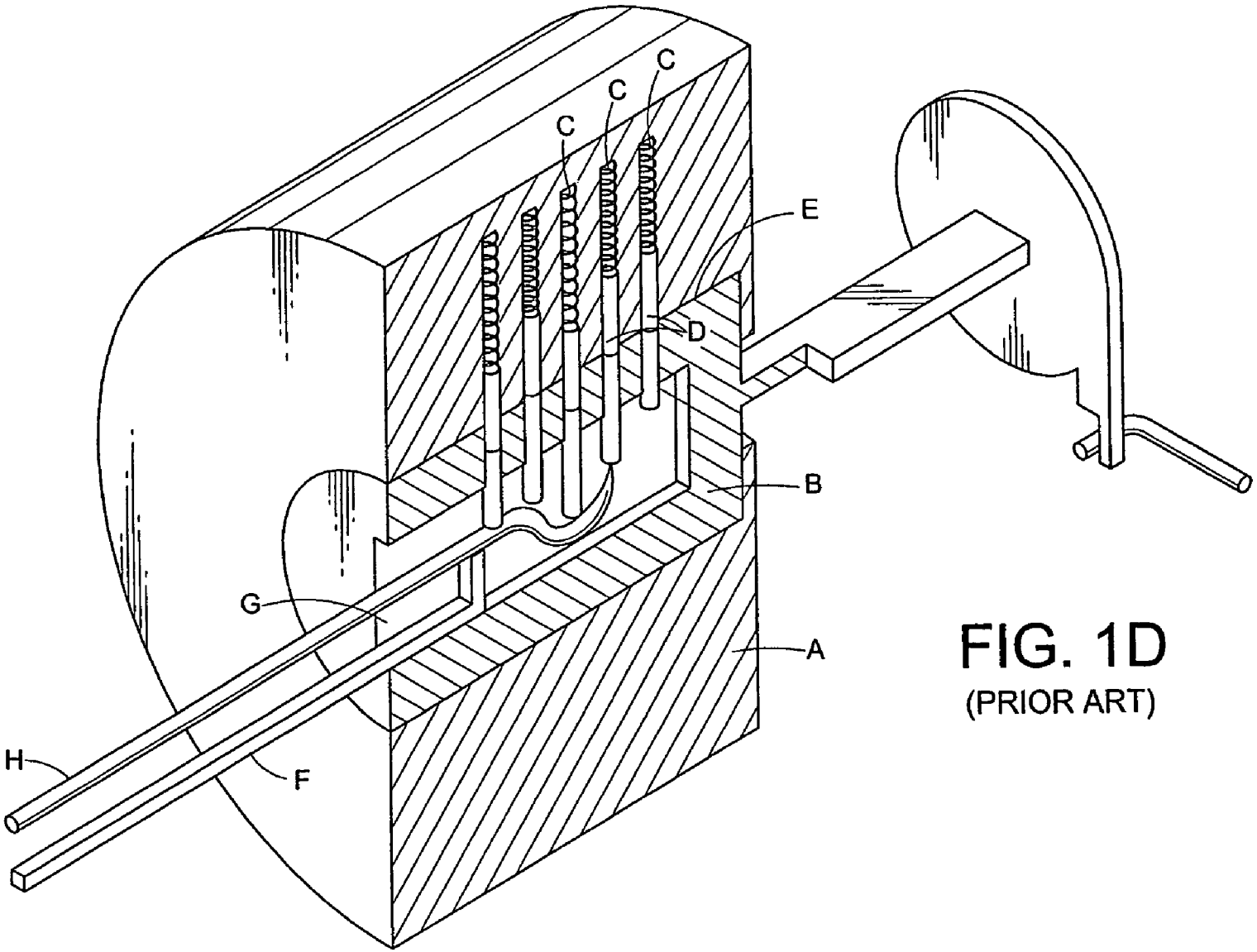
FIG. 1D (PRIOR ART)
Figure 1E:
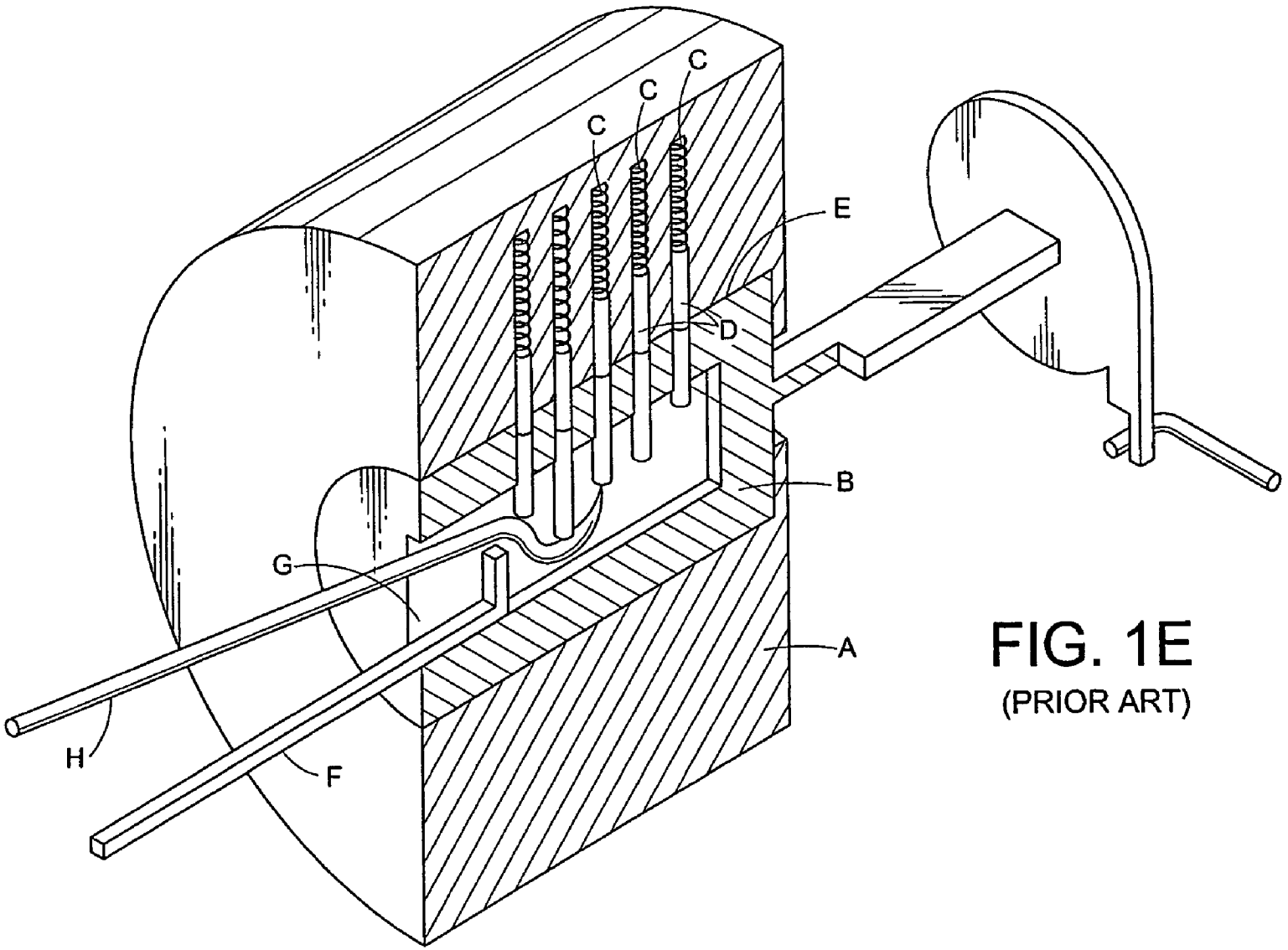
FIG. 1E (PRIOR ART)
Figure 1F:
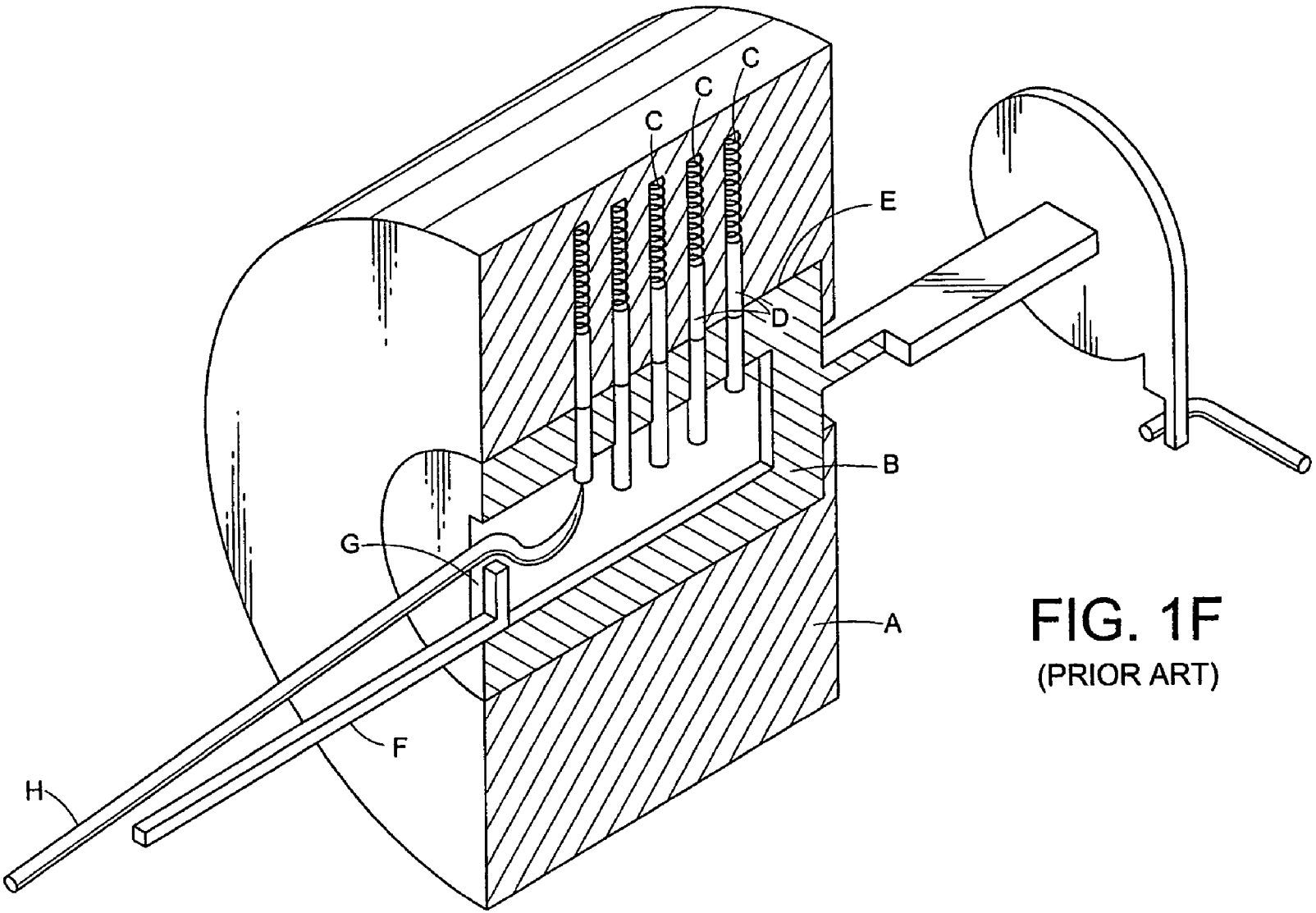
FIG. 1F (PRIOR ART)
Figure 1G:
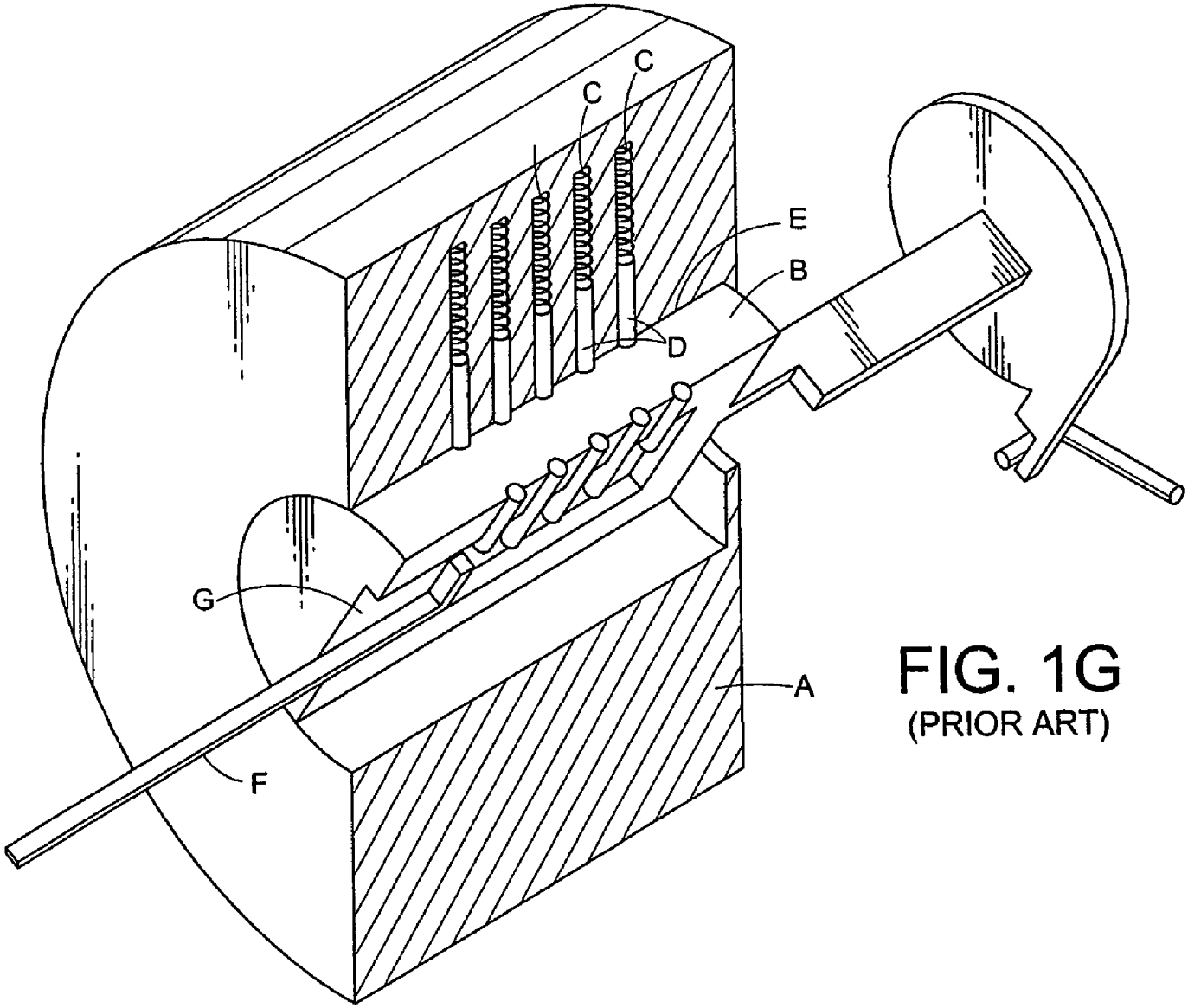
FIG. 1G (PRIOR ART)
Figure 2:
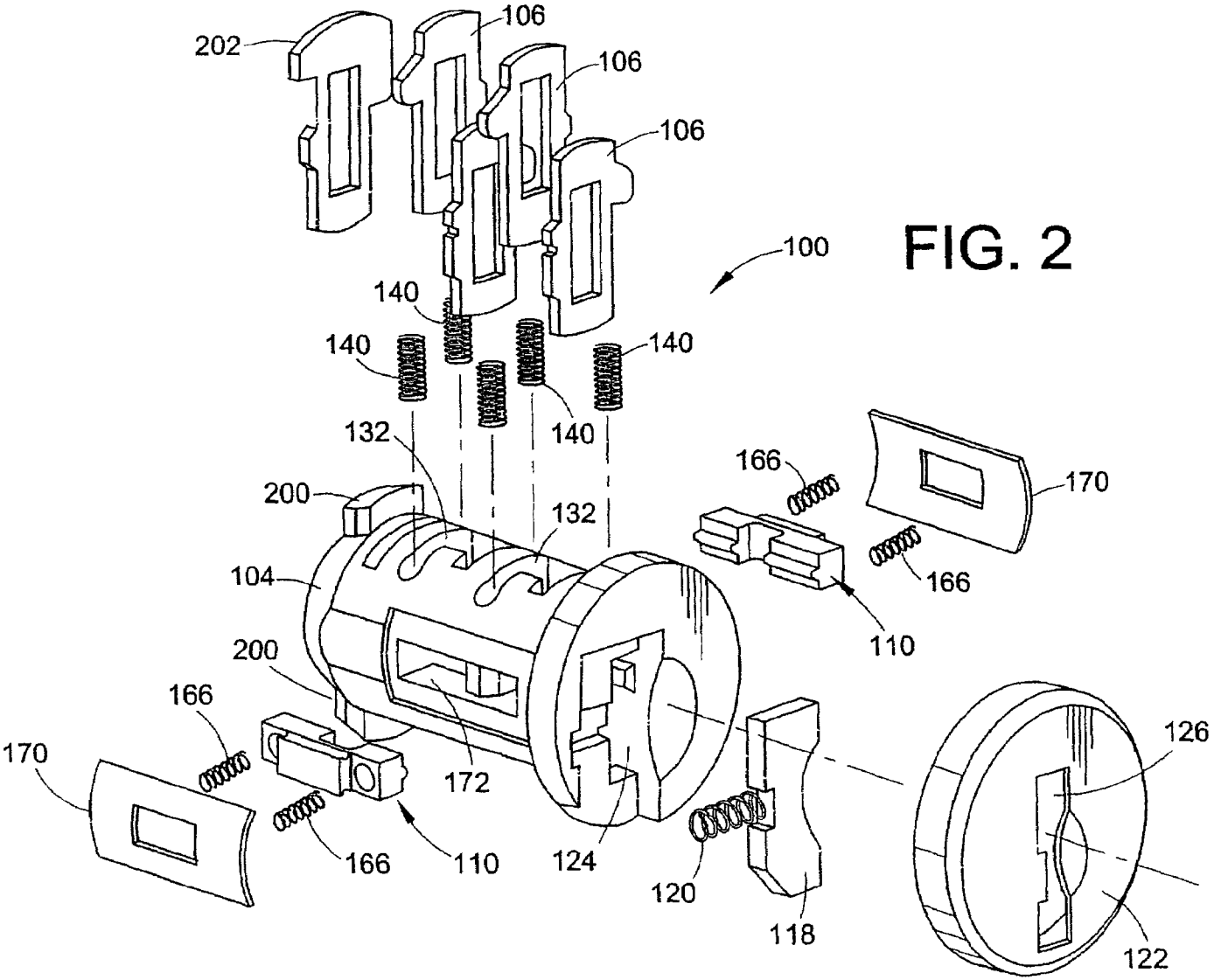
FIG. 2 is an exploded view of the wafer lock of the present invention.
Figure 3:
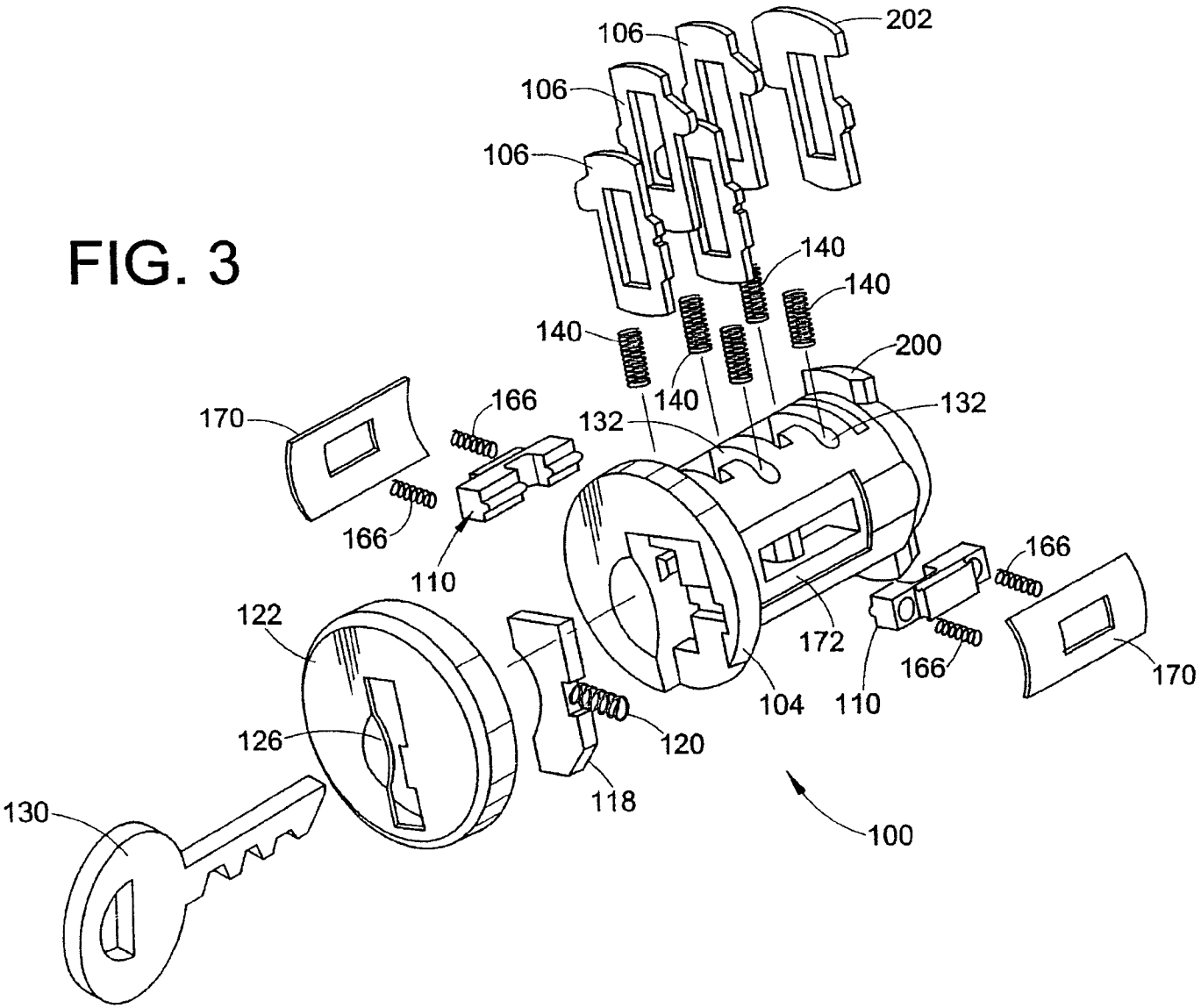
FIG. 3 is a view of the wafer lock of the present invention.

The present invention is a wafer tumbler locking mechanism, generally referenced as 100, including a lock body or shell 102, a lock cylinder 104, a set of spring-loaded wafer tumblers 106 and a set of spring-loaded sidebars 110. Optionally, the wafer lock may also include a cylinder door 118, cylinder door spring 120 and cylinder cap 122 which assemble into a cylinder plug 104 front opening 124.

The cylinder cap 122 contains an opening 126 into which a key 130 is inserted.

Figure 4:
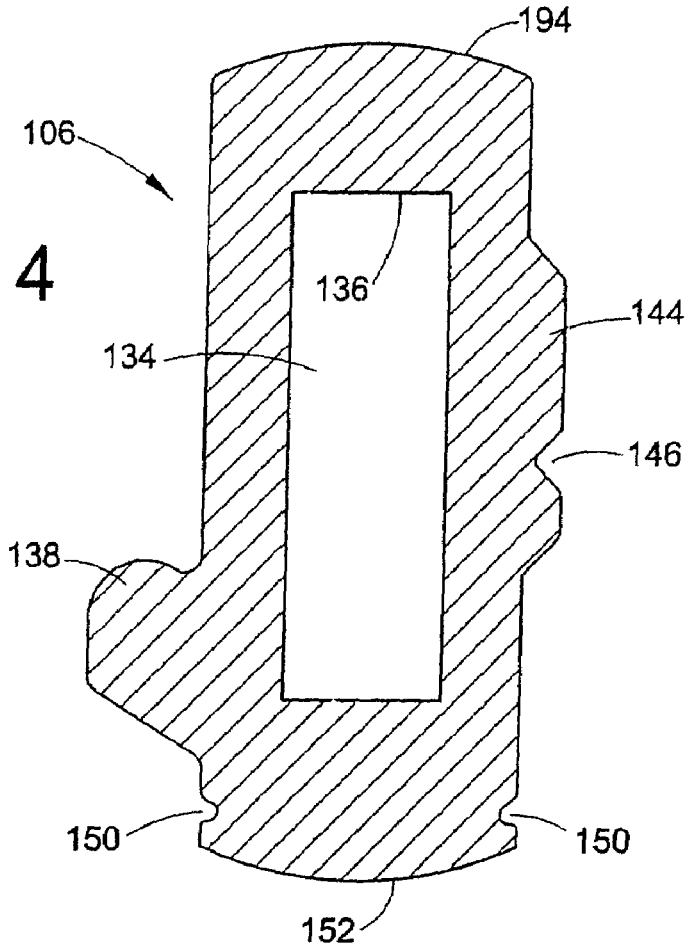
FIG. 4 is a front view of a wafer tumbler of the wafer lock.

As shown in FIG. 4, the wafer tumblers 106 are generally flat rectangular-shaped pieces that are arranged within a set of tumbler slots 132. While the wafer tumblers 106 are shown and described as flat, generally rectangular pieces, it should be appreciated that the wafer tumblers 106 can be a variety of shapes, sizes and configurations providing the wafer tumblers 106 still provide the functional aspects as described herein. Each wafer tumbler 106 has an opening 134 through the center of the tumbler though which a key 130 is inserted. These openings 134 are configured to mate with a key 130 such that when a key 130 is inserted through the keyway 131 and the openings 134 the notches in the key contact the upper edge 136 of the tumbler opening and thereby move the tumbler 106, as discussed in further detail below. Each wafer tumbler 106 has a spring tab 138 that protrudes from one side of the wafer tumbler 106 and contacts one end of the spring 140. The other end of the spring 140 contacts a surface 142 of the cylinder 104, thereby biasing the wafer tumbler 106 into engagement with the shell 102 as discussed below.

The wafer tumbler 106 also has a sidebar tab 144 protruding from the opposite side of the wafer tumbler 106 from the spring tab 138. The sidebar tab 144 includes cutout 146 for engaging the sidebar 110. While the cutout 146 is shown as a pointed recess within the sidebar tab 144, it should be appreciated that cutout 146 may also be rounded or contain different types of surfaces; however the cutout 146 should be configured to provide solid mating engagement with the sidebar 110. The wafer tumbler sidebar tab 146 may contact a sidebar 110 at a geometrically inversed projection 148 located on the sidebar 110. The projection 148 is used to maintain contact between the sidebar tab 144 and the sidebar 110 Wafer tumblers 106 may further include indentations 150 in one end of the tumbler 106 that form a camming surface with the lock shell 102. The indentations 150 are generally located along the bottom 152 of the wafer tumbler 106 which engages the lock shell 102 when the wafer tumbler 106 is in the locked position, as discussed below.

Figure 5:
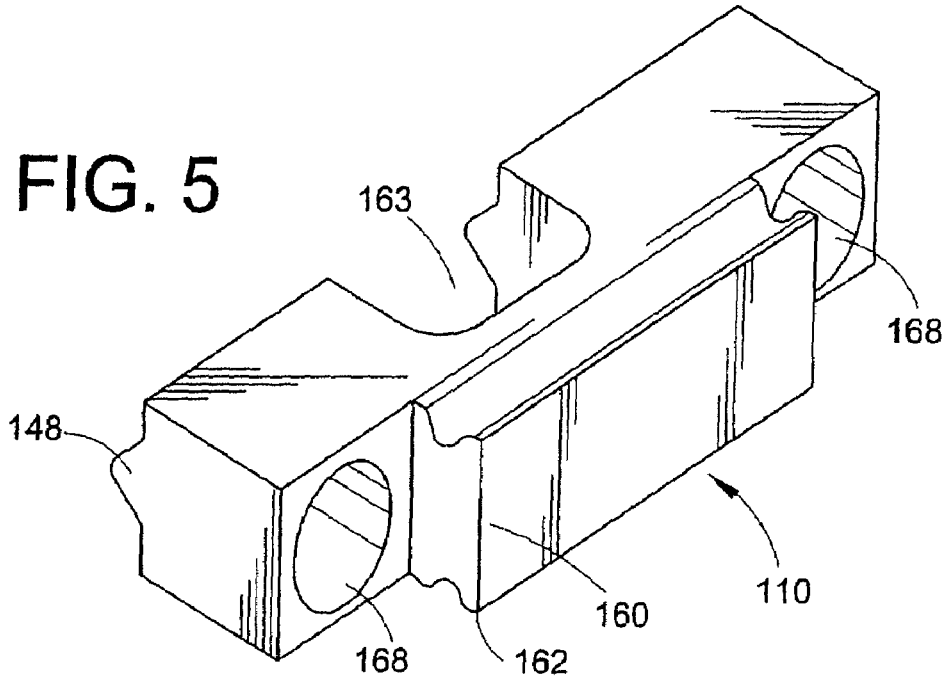
FIG. 5 is a view of a sidebar of the wafer lock.

The sidebars 110, shown in detail in FIG. 5, are rectangular with a rounded projection 160 with beveled sides 162 that forms a camming surface with the interior of the shell 102. The length of the sidebars 110 depend on the number of wafer tumblers 106 the sidebar interacts with. In one embodiment, the sidebars 110 are long enough to engage the two or more wafer tumblers 106 in every other fashion. While the wafer tumbler to sidebar ratio may be 1:1, it is preferable to have such ratio be 2:1, or greater, to further provide anti-picking protection. The sidebar 110 has a sidebar recess 163 which spans the area where the wafer tumbler spring 140 of the intervening wafer tumbler 106 is located. The sidebar 110 has a tumbler projection 148, located on either side of the recess 163, which contacts non-adjacent wafer tumblers 106. As mentioned above, the projection 148 contacts the sidebar tab 144 of the wafer tumbler 106 at the sidebar tab cutout 146. This wafer tumbler sidebar tab cutout 146 is located at various positions along the wafer tumbler sidebar tab 144. Each different position is aligned with the sidebar tumbler projection 148 by the notches on the key 130 at a different depth. As described above, contact between the tumbler projection 148 of the sidebar 110 band the wafer tumbler 106 determines whether the sidebar 110 is in a position of interference or non-interference with the lock shell. The separation of the sidebar 110 into two portions with the sidebar rounded projection 160 between them allows a rocking or pivoting motion in the sidebar 110 that decreases the ability of the sidebar 110 to seat in the sidebar cutouts 146 of both wafer tumblers 104 simultaneously unless positioned by a key 130. The sidebar is held in place within the cylinder 104 by sidebar springs 166, one end of which contacts the sidebar 110 at the blind hole 168 located at each end of the sidebar 110.

The wafer tumblers 106 and sidebars 110 fit into a cylinder plug 104, the wafer tumblers 106 generally located in the center of the cylinder plug 104 located in wafer slots 132, and the sidebars located between the wafer tumblers 106 and the lock shell 102. Optionally, a set of sidebar mounting plates 170 can be used to position the sidebars 110 into position between the wafer tumblers 106 and lock shell 102. The sidebars 110 are placed in the sidebar slots 172 located between the wafer tumblers 106 and the lock shell 102.

The lock shell 102 includes a top cavity 180, two side cavities 182, and a bottom cavity 184. Each of the shell cavities have a set of projections that act as a camming surface to prohibit rotation of the lock cylinder. Specifically, the top cavity 180 has a set of top projections 186, the side cavities 182 have a set of side projections 188, and the bottom cavity has a set of bottom projections 190. As assembled, and in the locked position, both the tumblers 106 and the sidebars 110 extend from the cylinder assembly 100 into cavities in the lock shell 102. So positioned, the tumblers 106 and sidebars 110 are in a position of interference with the lock shell 102, preventing rotation of the cylinder assembly 100 within the lock shell 102. When rotational torque is applied to the cylinder assembly 100 in the absence of the correct key, camming of the rounded projections 160 of the sidebars with projections 188 adjacent to side cavities 182 in the interior sides of the lock shell 102 results in pulling of the sidebars 110 farther into the shell side cavity 182 thereby locking the sidebars 110 in a position of interference with the shell 102. Likewise, when rotational torque is applied, in the absence of the correct key, camming of indentations 150 of the wafer tumblers 106 with projections 190 of the lock shell 102 adjacent to top cavity 180 or the bottom cavity 184 of the lock shell 102 results in preventing the wafer tumblers 106 from being moved toward the shell top cavity 108 or farther out of the shell bottom cavity 184 therein locking the wafer tumblers 106 in a position of interference with the shell 102. Additionally, to further prohibit rotation of the cylinder 104, the tolerance between the sidebars 110 and the lock shell 102 may be less than the tolerance between the wafer tumblers 106 and the shell 102. Therefore, when rotational torque is applied to the cylinder assembly 100 in the absence of the correct key 130, the beveled sides 162 of the sidebars 110 engage with the lock shell 102 before the indentations 150 of the wafer tumblers 106 engage with the lock shell 102. This feature prevents positioning of the wafer tumblers 106 in a position of non-interference by resting the ends of the tumblers 106 on the ledge of the shell 102 along the shear line. Furthermore, the spring force exerted by springs 140, which hold the wafer tumblers 106 in position, may be greater than the spring force exerted by springs 166, which hold the side-bars 110 in position. Providing a greater spring force on springs 140, as compared to springs 166, prevents the use of the sidebars 110 as a means for maintaining the wafer tumblers 106 in position of non-interference. As such, if a wafer tumbler 106 was moved to a position wherein it no longer interferes with the shell 102 in bottom shell cavity 184, and therefore allowing the sidebar 110 to move into position against the sidebar tab 144 of the wafer tumbler wherein the sidebar 110 moves to a position wherein it no longer interferes with the shell 102 in the side cavity 182, the spring force exerted by spring 140 would overcome the spring force exerted by spring 166 and the wafer tumbler 106 would spring back into the bottom cavity 184 of the shell 102.

Figure 6:
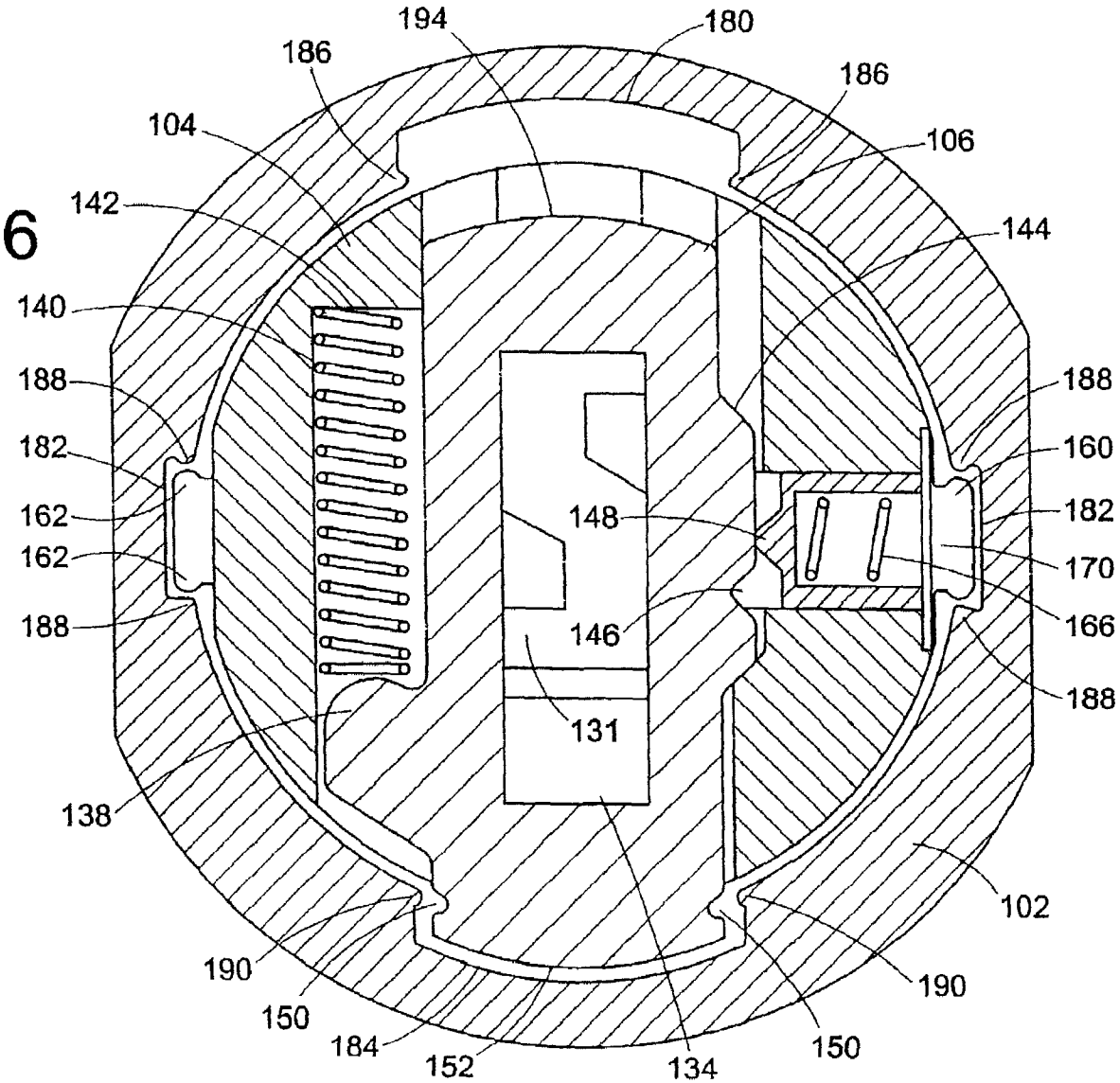
FIG. 6 is cross-sectional view of the cylinder assembly and shell of the wafer lock.

As shown, both the wafer tumbler 106 and the sidebar 110 are in a position of interference with the shell 102. Therefore, the locking mechanism is in the locked position. The cross-sectional view of FIG. 6 shows the wafer tumbler 106 assembled into the cylinder plug wafer slot 132 of the cylinder plug 104 with the wafer tumbler spring 140. The wafer tumbler spring 140 holds the wafer tumbler 106 in a position of interference with the shell 102, as shown by the wafer tumbler bottom end 152 positioned into the shell bottom cavity 184. The sidebar pointed projection 148 of the sidebar 110 contacts with the wafer tumbler sidebar tab 144 of the sidebar 110. The sidebar spring 166 pushes against the sidebar 110 to continually force the sidebar 110 toward the wafer tumbler 106. When the wafer tumbler sidebar cutout 146 is not aligned with the sidebar projection 148, as shown in FIG. 6, the sidebar projection 160 extends into the shell side cavity 182 to prevent rotation of the cylinder plug 102.

When rotational torque is applied to the interchangeable cylinder assembly 100, by an incorrect key for example, the interchangeable cylinder assembly 100 will not rotate due to the interference between the shell 102 and the wafer tumblers 106 and the sidebars 110. When rotational torque is applied to the locking mechanism, without use of the correct key, the beveled side of rounded sidebar projection 162 contacts and cams with the shell side projection 188 and pulls the sidebar projection 160 into the shell side cavity 182. Additionally, when rotational torque is applied to the lock, in the absence of the correct key, the wafer tumbler indentations 150 engage with the shell bottom projections 190 This engagement prevents upward movement of the wafer tumbler 106 into a position of non-interference. To further prevent the possible picking of the lock, the tolerance between the sidebars 110 and the shell 102 may be less than the tolerance between the wafer tumblers 106 and the shell 102. Therefore, when rotational torque is applied in absence of the correct key, the sidebar projection 160 engages with the shell 102 before the wafer tumbler 106 engages with the shell 102. Since the wafer tumbler 106 fails to contact the shell 102, it is not possible to wedge the wafer tumbler 106 into a position along a ledge that is created along the shear line, as is attempted when the lock is picked.

If the correct key 130 is inserted into the keyway 131 of the interchangeable cylinder assembly 100, the cuts on the key will position the wafer tumbler 106 within the cylinder plug 104 so that the ends of the wafer tumbler 106, the wafer tumbler top end 194 and the wafer tumbler bottom end 152, become flush with the outside diameter of the cylinder plug 104 and, at the same time, align the wafer tumbler sidebar cutout 146 with the sidebar pointed projection 148. When the sidebar pointed projection 148 is aligned with the wafer tumbler sidebar cutout 146, the sidebar 110 moves inward until the beveled side of rounded sidebar projection 162 is also flush with the outside diameter of cylinder plug 104. At that point, rotational torque applied to the key 130 causes the cylinder plug 104 to rotate within the shell 102, thereby unlocking the wafer tumbler locking mechanism.

Locking mechanisms are contemplated that have between 4 and 11 wafer tumblers 106 and between 2 and 5 sidebars 110. If the locking mechanism also comprises the interchange ability feature, whereby one interchangeable cylinder assembly 100 can be removed from the lock shell 102 and replaced with another interchangeable cylinder assembly 102 for the purposes of re-keying the lock, then an additional tumbler, called a shell locking tumbler 202 is used in the design.

Figure 7:
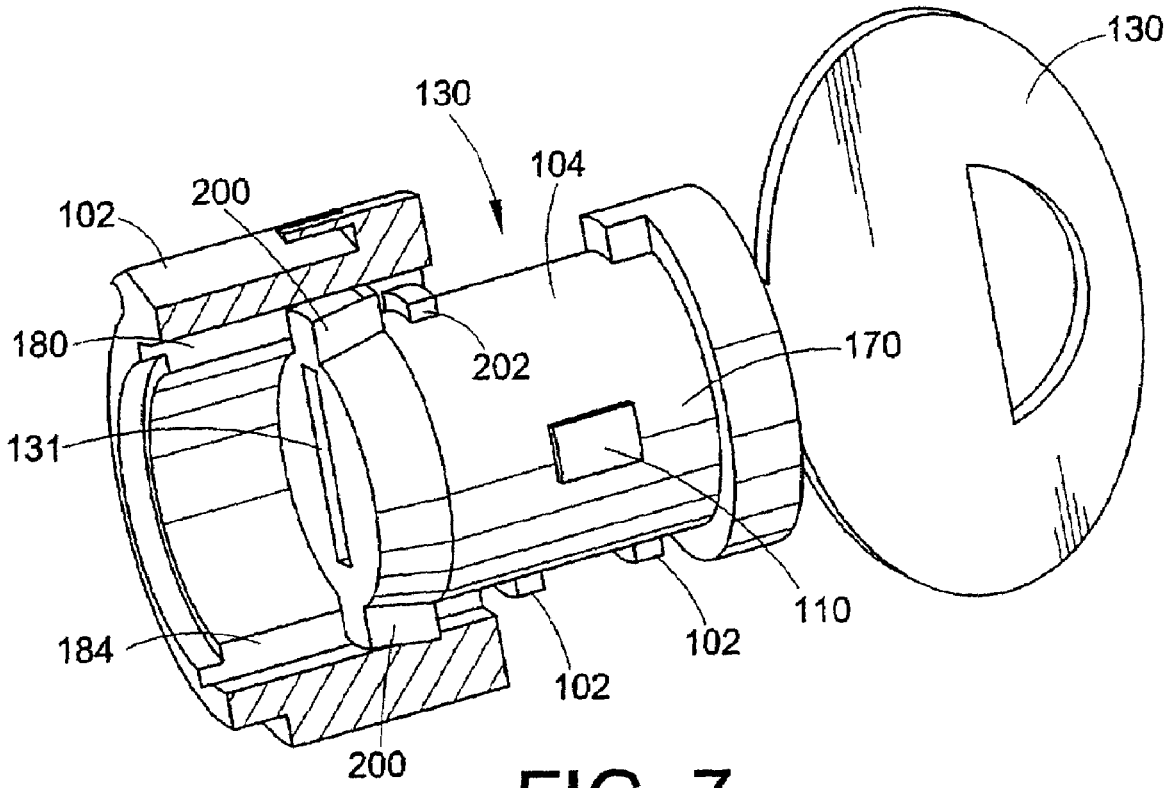
FIG. 7 is a cross-sectional view of the interchangeable cylinder assembly partially inserted into the shell.
Figure 8:
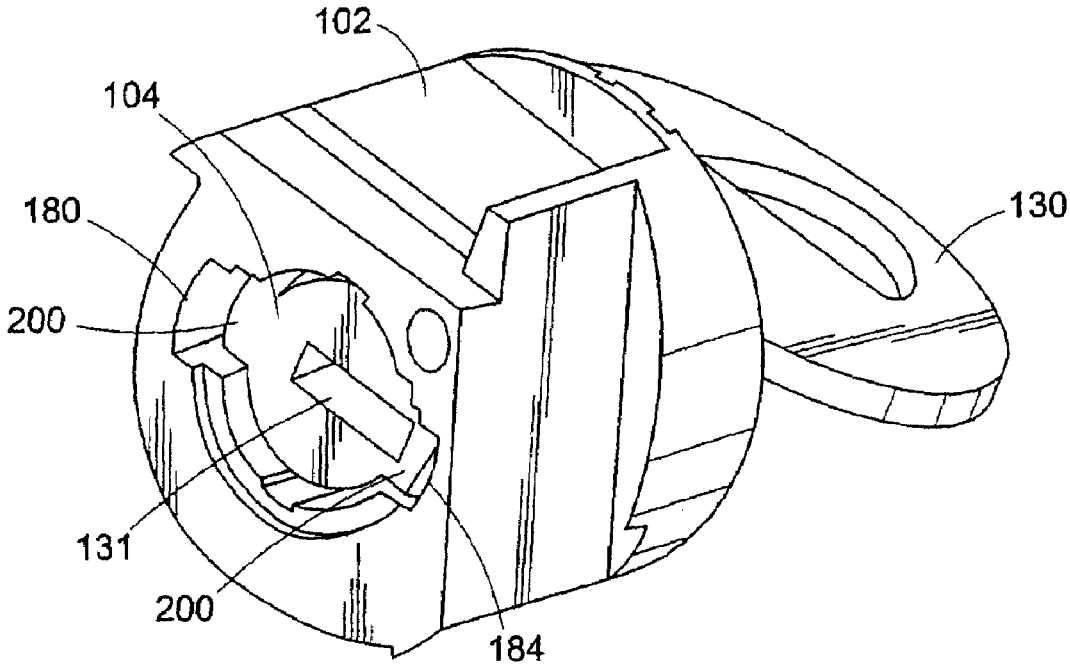
FIG. 8 is a view of the interchangeable cylinder assembly partially inserted into the shell.

FIGS. 7, 8, 9 and 10 are views of the interchangeable cylinder assembly 100 and surrounding lock shell 102. These figures particularly show the features of the interchangeable cylinder feature of the lock. FIG. 7 is a cross-sectional view of the interchangeable cylinder assembly 100 in the unlocked position and partially inserted into the shell 102. The cylinder plug retainer lugs 200 are aligned and inserted into the shell through the wafer cavities 180 and 184. The interchangeable cylinder assembly 100 is inserted into the shell 102 in the direction of the arrow. Also shown is a shell locking tumbler 202 which is a single wafer at the end of the cylinder plug 104 that is nearest to the cylinder plug retainer lugs 200. The shell locking tumbler 202 locks the interchangeable cylinder assembly 100 into the shell 102 after it has been completely inserted therein. FIG. 7 shows a rear view of the interchangeable cylinder assembly 100 being inserted into the shell 102. In this view, the interchangeable cylinder assembly 100 has been almost pushed all the way into the shell 102. The cylinder plug retainer lugs 200 are shown aligned with the wafer cavities 180 and 184. FIG. 8 shows a view of the interchangeable cylinder assembly 100 partially inserted. Once completely inserted, the interchangeable cylinder assembly 100 is rotated such that the cylinder plug retainer lugs 200 are offset from wafer cavities 180 and 184. In this position, the interchangeable cylinder assembly 100 cannot be pulled out of the shell 102 without rotating the interchangeable cylinder assembly 100 back to a position where the cylinder plug retainer lugs 200 align with wafer cavities 180 and 184 in the shell 102. Once the interchangeable cylinder assembly 100 is positioned within the shell 102 as shown in FIG. 9, a special key can be inserted into the keyway 131 of the lock, causing retraction of the shell locking tumbler 202 into the lock cylinder plug 104. In this position, the interchangeable cylinder assembly 100 can be removed from the shell 102 of the lock.

An additional feature of the lock is that the cylinder assembly 100 is easily removable from the lock shell 102 and replaceable with a different cylinder assembly 100 for the purpose of re-keying the lock. The cylinder plug 104 has cylinder plug retainer lugs 200 at the end opposite from the end where the key 130 is inserted. These retainer lugs 200 are important to the interchangeability of the interchangeable cylinder assembly 100 as they are different widths and will only allow the cylinder plug to be removed with a certain orientation. The interchangeable cylinder assembly 100 can easily be removed from the shell 102 and a different interchangeable cylinder assembly 100 can be inserted. The interchangeable cylinder assembly 100 is locked into place within the shell 102 by a shell locking tumbler 202. This interchangeability feature allows rapid re-keying of the lock.

The description above generally disclosed an interchangeable cylinder design for a cylinder that rotated 180 degrees to move the lock from the locked position to the unlocked position, or vice versa. Some locks do not require 180 degrees of rotation in order to move the lock between the locked and unlocked positions. Some locks use only 45 degrees or rotation, while others use 90 degrees of rotation. Other locks may require 360 degrees of rotation. Still other locks may require some other degrees of rotation, not stated above. As such, it is desirable to provide an interchangeable lock that can accommodate each of these degrees of rotation.

Figure 11:
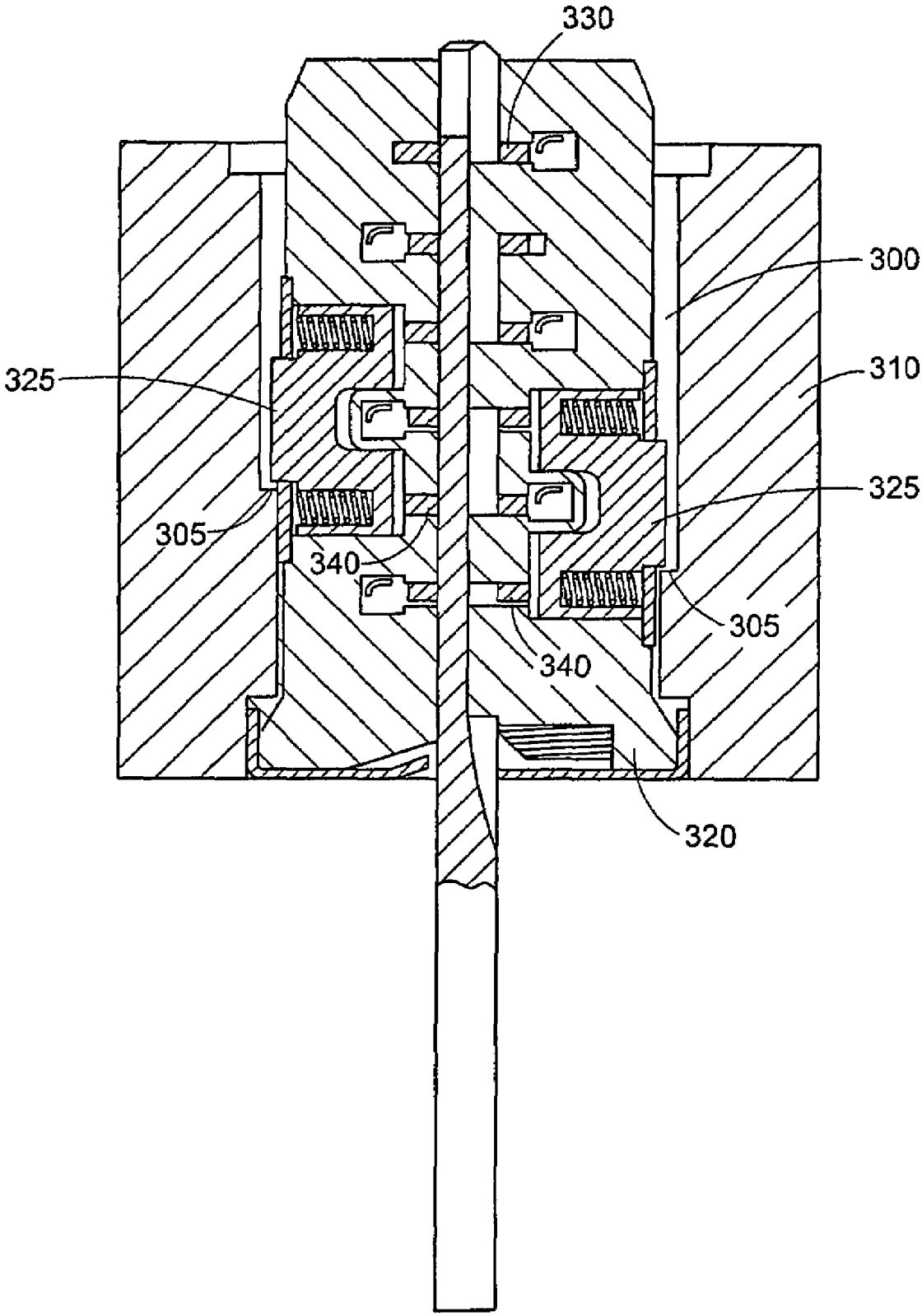
FIG. 11 is a cross-sectional view of a lock assembly including raised edges that engage the sidebars.

In order to make the mechanism compatible with the other locking mechanisms that require different degrees of cylinder rotation in order to move the lock from the locked position to the unlocked position, the embodiment shown in FIG. 11 is used.

As shown in FIG. 11, cylinder cavity 300 is not continuous from the front of the lock to the back of the lock. Instead, the cylinder cavity 300 is interrupted by a raised surface or ledge 305 within the lock shell 310. The ledges 305 prevent the cylinder plug 320 from being removed from the lock shell 310 unless the sidebars 325 are retracted within the cylinder plug 320. In the prior embodiments, the sidebars required alignment of the projection 160 with the shell side cavity 182. This limits the degrees of rotation between the locked and unlocked positions. In the embodiment shown in FIG. 11, the sidebars 325 do not include a projection that must be aligned, but instead interfere with ledge 305 regardless of orientation. As such, the cylinder plug 320 can have any degree of rotation between the locked and unlocked positions desired. The interference between the sidebars 325 and the ledge 305 assists in retaining the cylinder plug 320 in the shell 310. As with the other embodiments, a shell locking tumbler and retainer lugs are used to secure the plug 320 within the shell and to orient the plug 320 during insertion of removal to avoid misalignment of the plug and the locking mechanism with the lock.

In order to remove the lock cylinder, a special tool must be used. This tool, in addition to the extra length required to reach the shell locking tumbler 330, has the correct key bitting combination to move the wafer tumblers 340 and sidebars 325 to a position of non-interference (i.e. to open the lock). This tool allows the sidebars 325 to retract completely within the plug 320 and, the extra length causes retraction of the shell locking tumbler 330.

The invention claimed is:

1. A lock comprising:

a lock shell including a cylinder cavity, said cylinder cavity defining at least one sidewall cavity and a tumbler cavity, said at least one sidewall cavity having a set of projections;

a first removable lock cylinder that can rotate between a locked position and an unlocked position;

a plurality of tumblers that selectively extend into said tumbler cavity; and one or more sidebar members that are selectively engageable with said set of projections to allow the lock cylinder to be removed from the lock shell only when said one or more sidebar members are disengaged from said at least one sidewall cavity and said plurality of tumblers are disengaged from said tumbler cavity.

2. The lock of claim 1, wherein said first lock cylinder can rotate a first number of degrees to move between said locked and unlocked positions.

3. The lock of claim 1, wherein said one or more sidebar members are spring-biased away from said at least one sidewall cavity.

4. The lock of claim 1 further comprising one or more springs engaged with at least one of said one or more sidebar members, said one or more springs arranged to force at least one of said one or more sidebar members toward said tumblers.

5. The lock of claim 1 further comprising a shell locking tumbler.

6. The lock of claim 1 wherein engagement between said one or more sidebar members and said set of projections prohibits rotation of said lock cylinder.

7. The lock of claim 1 wherein engagement between said one or more sidebar members and said set of projections prevents said removable lock cylinder from being removed from said lock shell.

8. The lock of claim 1 further comprising a tumbler spring and a sidebar spring, wherein said tumbler spring is stronger than said sidebar spring.

9. The lock of claim 1 wherein a tolerance between said one or more sidebar members and said lock shell is less than a tolerance between said plurality of tumblers and said lock shell.

10. A locking mechanism comprising:

a lock shell including a cylinder cavity defined by an inner wall, said inner wall defining at least one sidewall cavity and a tumbler cavity;

a removable lock cylinder having a keyway therein and rotateably disposed within said cylinder cavity;

a plurality of tumblers contained within said lock cylinder and selectively movable in a first direction to extend into said tumbler cavity; and one or more sidebar members disposed on said lock cylinder and selectively moveable in a second direction which is generally perpendicular to said first direction to form a sidebar member first position and a sidebar member second position;

said at least one sidewall cavity having at least one projection, wherein said one or more sidebar members engages said at least one projection when rotated in said first position and disengages from said at least one projection when in said second position, wherein engagement between said one or more sidebar members and said at least one projection in said first position prevents engagement of said plurality of tumblers with said tumbler cavity.

11. The locking mechanism of claim 10, wherein said lock cylinder can be removed from said shell only when said one or more sidebar members disengage said at least one projection and said plurality of tumblers disengage said tumbler cavity.

12. The locking mechanism of claim 10 further comprising a shell locking tumbler.

13. The locking mechanism of claim 10 further comprising a tumbler spring and a sidebar spring, wherein said tumbler spring is stronger than said sidebar spring.

14. The locking mechanism of claim 10 wherein a tolerance between said one or more sidebar members and said lock shell is less than a tolerance between said plurality of tumblers and said lock shell.

15. A lock including a locking mechanism comprising:

a lock shell including a cylinder cavity defined by an inner wall, said inner wall defining at least one sidewall cavity and a tumbler cavity;

a removable lock cylinder having a keyway therein and rotateably disposed within said cylinder cavity;

a plurality of tumblers contained within said lock cylinder and selectively movable in a first direction to extend into said tumbler cavity; and one or more sidebar members disposed on said lock cylinder and selectively moveable in a second direction which is generally perpendicular to said first direction to form a sidebar member first position and a sidebar member second position;

one or more springs engaged with said one or more sidebar members, said one or more springs arranged to force said one or more sidebar members toward at least one of said plurality of said tumblers;

said at least one sidewall cavity having at least one projection, wherein said one or more sidebar members engages said at least one projection when rotated in said first position and disengages from said at least one projection when in said second position, wherein engagement between said one or more sidebar members and said at least one projection in said first position prevents engagement of said plurality of tumblers with said tumbler cavity.

16. The lock of claim 15, wherein said lock cylinder can be removed from said shell only when said one or more sidebar members disengage said at least one projection and said plurality of tumblers disengage said tumbler cavity.

17. The lock of claim 15 further comprising a shell locking tumbler.

18. The lock of claim 15, wherein said plurality of tumblers includes at least four tumblers.

19. The lock of claim 15, wherein said one or more sidebar members are spring-biased into said second position.

20. The lock of claim 15 wherein engagement between said one or more sidebar members and said at least one projection prohibits rotation of said lock cylinder.

21. The lock of claim 15 further comprising a tumbler spring, wherein said tumbler spring is stronger than said one or more sidebar springs.

22. The lock of claim 15 wherein a tolerance between said one or more sidebar members and said lock shell is less than a tolerance between said plurality of tumblers and said lock shell.

* * * * *